US005593941A

United States Patent [19]

Kato et al.

[11] Patent Number: 5,593,941

[45] Date of Patent: Jan. 14, 1997

[54] PROCESS FOR PRODUCTION OF THERMALLY TRANSFERRED IMAGE-RECEPTIVE SHEET

[75] Inventors: Hiromoto Kato, Omihachiman; Hiroshi Fukuhara, Hikone, both of Japan

[73] Assignee: Dynic Corporation, Kyoto, Japan

[21] Appl. No.: 363,827

[22] Filed: Dec. 27, 1994

[30] Foreign Application Priority Data

Dec. 28, 1993 [JP] Japan ..... 5-335100
Nov. 1, 1994 [JP] Japan ..... 6-268615

[51] Int. Cl.[6] ..... B41M 5/035; B41M 5/38

[52] U.S. Cl. ..... 503/227; 427/152; 427/355; 428/195; 428/287; 428/373; 428/401; 428/475.2; 428/475.5; 428/913; 428/914

[58] Field of Search ..... 427/152, 355; 503/201, 227; 8/471; 428/195, 286, 287, 475.2, 475.5, 480, 913, 914, 373, 401

[56] References Cited

FOREIGN PATENT DOCUMENTS 3-021487 1/1991 Japan ..... 503/227

*Primary Examiner*—Bruce H. Hess
*Attorney, Agent, or Firm*—Jacobson, Price, Holman & Stern, PLLC

[57] ABSTRACT

There is disclosed a process for production of a process for production of a thermally transferred image-receptive sheet which comprises:

(a) coating a coating composition containing nylon, methanol and calcium chloride onto a woven fabric substrate, (b) dipping the coated substrate into water to solidify a coated layer and leach out methanol and calcium chloride, wherein a microporous surface layer is formed so that the bottom of woven fabric is just filled up, (c) drying the dipped substrate, and (d) furnishing the dried substrate to obtain a final product, wherein a cover factor of woven fabric in the final product is not lower than 1700 and a ratio of cover factor of woven fabric immediately after coating relative to that of the final product is 0.97 to 1.03.

4 Claims, 3 Drawing Sheets

PROCESS FOR PRODUCTION OF THERMALLY TRANSFERRED IMAGE-RECEPTIVE SHEET

FIELD OF THE INVENTION

The present invention relates to a process for production of a thermally transferred image-receptive sheet having improved smoothness, and excellent cushioning properties, thermal shapeability, resistance to solvents and resistance to washing.

BACKGROUND OF THE INVENTION

A thermally transferred image-receptive sheet used for thermal transfer printing utilizing thermal transfer imaging or sublimation transfer imaging requires clarity of the image. Important factors in the clarity are smoothness and cushioning properties of the surface of the image-receptive sheet.

On the other hand, from a viewpoint of handling, such as outdoor use and the like, the image-receptive sheet requires strength, resistance to folding, permanence properties and resistance to water in some cases.

As a thermally transferred image-receptive sheet possessing simultaneously smoothness, cushioning properties and strength, there have been thermally transferred image-receptive sheets wherein a polyamide or polyurethane microporous layer is provided on a substrate, such as woven fabric and nonwoven fabric. These types of thermally transferred image-receptive sheets have been generally produced by coating a nylon coating composition containing calcium chloride, methanol and nylon as a main component or a polyurethane coating composition containing dimethylformamide and polyurethane as a main component on a substrate, dipping the coated substrate to form a nylon or polyurethane microporous layer while leaching out the solvent and the like (for example, see JP-A 03-021487).

In such prior art, the coated substrate was dipped into water, dried and furnished. In the furnishing step, regarding a cover factor of woven fabric, a ratio of a cover factor thereof immediately after coating relative to that of a final product (referred to as "a cover factor ratio" hereinafter) was relatively large (a cover factor ratio was above 1.03). Alternatively, another attempt was tried by carrying out such furnishing step, followed by a calendering step.

On the other hand, there has been a demand for high clarity of the image. In order to respond to this demand, smoothness of a thermally transferred image-receptive sheet obtained by a process wherein a relatively large cover factor or a roll method (calendering method) is used is required to be further improved.

OBJECT OF THE INVENTION

The main object of the present invention is to provide a process which can further improve smoothness of a thermally transferred image-receptive sheet.

This object as well as other objects and advantages of the present invention will become apparent to those skilled in the art from the following description with reference to the accompanying drawings.

SUMMARY OF THE INVENTION

In view of the above circumstances, the present inventors studied intensively and, as the result, found that a thermally transferred image-receptive sheet having improved smoothness can be unexpectedly obtained by forming a microporous layer on the surface of woven fabric to such an extent that the bottom of woven fabric is just filled up.

That is, the present invention provides a process for production of a thermally transferred image-receptive sheet which comprises:

(a) coating a coating composition containing nylon, methanol and calcium chloride onto a woven fabric substrate, (b) dipping the coated substrate into water to solidify a coated layer and leach out methanol and calcium chloride, wherein a microporous surface layer is formed so that the bottom of woven fabric is just filled up, (c) drying the dipped substrate, and (d) furnishing the dried substrate to obtain a final product, wherein a cover factor of woven fabric in the final product is not lower than 1700 and a ratio of cover factor of woven fabric immediately after coating relative to that of the final product is 0.97 to 1.03.

DETAILED DESCRIPTION OF THE INVENTION

Figure 1:
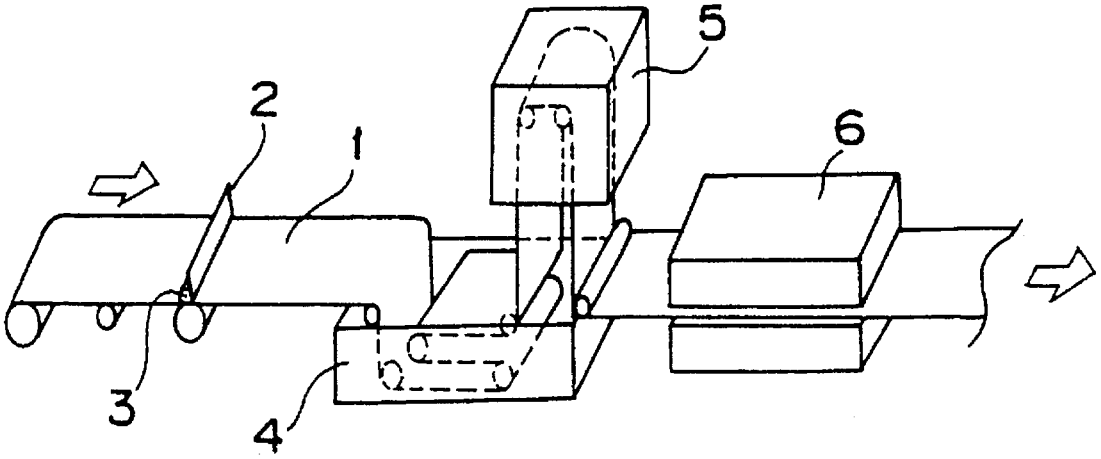
FIG. 1 is a perspective view showing an apparatus for producing a thermally transferred image-receptive sheet according to the present process.

Referring to FIG. 1, a process of the present invention comprises fundamentally steps: coating step, coated layer solidifying step, drying step and furnishing step.

Firstly, woven fabric is used as a substrate to be delivered to coating step. Preferable woven fabric materials are synthetic fibers, such as polyester and nylon, from a viewpoint of resistance to water, resistance to folding and the like. Alternatively, other synthetic fibers, such as acrylic, vinylon, vinylidene fiber and the like, may be used. As a yarn, filament yarn is preferable wherein a component single yarn is fine. Since monofilament, thick yarn and twisted yarn have inferior smoothness, they are not preferable. Therefore, non-twisted yarn is preferable. From a viewpoint of material and thickness, nylon 30–210$^d$, preferably 50–110$^d$ taffeta; polyester 30–150$^d$, preferably 50–110$^d$ taffeta and 30–150$^d$, preferably 50–110$^d$ core-sheath fiber woven fabric (polyester/nylon) (core fiber; polyester) are particularly preferable. The above synthetic fibers other than nylon and polyester fiber can be used as woven fabric in a substrate, as far as they are composed of filament yarns and thickness thereof is 30–210$^d$.

In addition, polyester taffeta and other synthetic fibers other than nylon fiber (sheath fiber is other than nylon fiber, in the case of core-sheath fiber) are preferably impregnated with a resin, such as nylon, urethane, EVA and the like, in order to improve adhesion between a substrate and a nylon microporous layer formed thereon.

In coating step, a substrate of continuous length 1 is first delivered therein using, for example, roll method or yard-fold method.

In coating step, a nylon coating composition is coated onto the delivered substrate.

Examples of nylon used in the nylon coating composition are nylon 6, nylon 6—6, nylon 8 and the like. From a viewpoint of deforming and resilient properties of a microporous layer formed in later step by setting pressure, surface tackiness and like, nylon 6 and nylon 6—6 are preferably used. A nylon coating composition contains 5 to 50% by weight, preferably 10 to 28% by weight of nylon. Further, a nylon coating composition contains methanol and calcium chloride for forming a microporous layer. An amount of methanol to be contained is 40 to 80% by weight, preferably 55 to 60% by weight on the basis of the weight of total weight of a nylon coating composition. An amount of calcium chloride to be contained is 15 to 35% by weight, preferably 20 to 29% by weight on the basis of the total weight of a nylon coating composition.

As other components, a nylon coating composition may contain a filler, such as clay, silica, calcium carbonate, talc and the like; a plasticizer such as sulfonamides, aromatic oxycompounds, carbamic ester, DOA and the like; an anti-static agent, such as amine, polyoxyethylene ether and the like, from a viewpoint of workability in the process of production or final utility of a printed image-receptive sheet.

A nylon coating composition is prepared by mixing the above components. The viscosity of a nylon coating composition is preferably 500 to 2000 cps at 40° C. by measurement using a B type viscometer, from a viewpoint of workability upon coating.

The composition thus prepared is coated onto a substrate. Coating is carried out onto one side or two sides of the substrate depending upon the intended utility. FIG. 1 show an embodiment wherein a composition 3 is coated onto one side of the substrate using a doctor knife 2 and an on-roll method.

Besides on-roll method, examples of a coating method are floating method, blanket method, slit-coat method, reverse-coat method, cast-coat method. For obtaining an image-receptive sheet having excellent smoothness, on-roll method, floating method and blanket method are effective.

An amount to be coated is such that the bottom 12 of woven fabric is just filled up so as to form a coated layer. As used herein, the description "the bottom of woven fabric is just filled up" refers to the situation where the top 11 of woven fabric is extremely near zero and the surface of coated layer is flat (see FIG. 3). The reason why such the amount to be coated is selected is as follows: As the thickness is growing larger starting from the above just filled up situation, the feeling of a woven fabric is lost gradually and the surface peel strength (picking test using Denison wax, pressure sensitive adhesive tape and the like) of the coated layer is decreased. Therefore, an amount to be coated is limited to some extent and, when a doctor knife is used, coating is carried out by contacting a tip of the knife with woven fabric so that the knife scrapes the crest of fiber in woven fabric.

Usually, coating is carried out once to four times. For example, the particular amount to be coated is 15 to 30 g/m$^2$ when a substrate is nylon taffeta 70 d (total density 210/inch$^2$).

In addition, coating is usually carried out while tension is applied to a substrate in the longitudinal direction (delivering direction of a substrate) at 0.5 to 1.5 kg/cm.

In next coated layer solidifying step, the coated substrate is delivered to a water cistern 4, and dipped into water having pH of 3 to 8 to leach out calcium and methanol. For example, when $CaCO_3$ is used as a filler, hydrochloric acid is added thereto to adjust pH to acidic in order to remove $CaCO_3$ by decomposition.

Such leaching out forms a nylon microporous layer on a substrate. Upon this, a part of a substrate is dissolved, which results in incorporation of a substrate and a microporous layer. As used herein, the term "microporous" refers to a layer possessing pores having the diameter of about 0.1 to 5 μm.

In order to obtain excellent smoothness, solidification (gelation) is successively caused starting from the surface of coated layer. Successive solidification occurs by dipping into water as described above. Alternatively, only placing water on a substrate causes successive solidification. Upon this, since the solvent contained in a coating composition is successively leached out and the leached out solvent is displaced by water, volume reduction is not or hardly caused in a formed nylon microporous layer. In this respect, volume reduction is caused when a coating composition containing a solvent is heated. The present process is different from the heating method. Thus, volume reduction of a microporous layer is hardly caused in solidifying step in the present process, and the situation where the bottom of woven fabric is just filled up is maintained also in a final product.

Drying is carried out using a drier 5. A temperature for drying is usually at 100° to 150° C. and a time for drying is about 180 to 10 seconds depending upon the temperature for drying. The drying method includes and is not limited to nontouch-drying method, cylinder-drying method, tenter-drying method, floating-drying method, arch-drying method and the like.

In furnishing step, furnishing is carried out so that a cover factor of a final product becomes not lower than 1700, preferably not lower than 2000 and a cover factor ratio becomes 1.0 to 1.03.

A cover factor (K) is calculated according to the following equation:

$$K=m/p$$

wherein m is the diameter of yarn and p is the distance between yarns. For simplicity, a cover factor is calculated according to the following equation:

$$K=n\sqrt{N}$$

wherein n is density (/inch$^2$), N is count of yarn. In the case of filament yarn, $K=n\sqrt{D}$, wherein n is density, D is denier value, wherein $D=9000\times W/L$, wherein W is weight and L is length.

Figure 2:
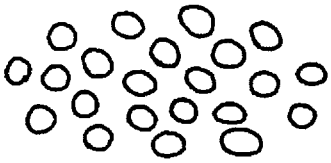
FIG. 2 is a cross sectional view schematically showing flattened filament yarns and non-twisted yarns in woven fabric.

When woven fabric composed of filament yarn or non-twisted yarn (naturally twisted yarn) is used, a cross section of a yarn is out of round or flattened and, thereby, a cover factor becomes substantially larger than that obtained by the above equation (because the diameter of a yarn becomes larger due to flattening). In such the case, the following equation is used:

$$K=n\times\sqrt{D'},\ D'=D\times k$$

wherein k is correction factor and is obtained by dividing the major axis shown in FIG. 2 by the corresponding diameter if a cross section of the same yarn is circle. Correction factor (k) is usually within a range of 1.3 to 1.8 and a cover factor (K) is calculated by selecting correction factor from the above range.

In the previous furnishing step where a cover factor ratio was relatively large (above 1.03), the warps were moved by furnishing treatment and, as the result, protuberances are formed. This is considered to be the reason why surface smoothness of a microporous layer after furnishing was. insufficient in the case of the previous furnishing treatment.

It has been now found that smaller cover factor ratio prevents the warps of a substrate from moving and, thereby, surface smoothness is improved.

In the furnishing step, furnishing is carried out by grasping a substrate with a tenter 6. Examples of the tenter are pin tenter, clip tenter and roller setter. In addition, the roller setter must be equipped with a trimming instrument.

A temperature in the furnishing step is generally higher to some extent than that in the above drying step.

One embodiment of a cover factor in the present process is shown together with that in the previous process.

| | Immediately after coating | Furnishing treatment | Cover factor ratio |
|---|---|---|---|
| Previous process | 3130 | 3009 | 1.04 |
| Present process | 3130 | 3101 | 1.01 |

Figure 3:
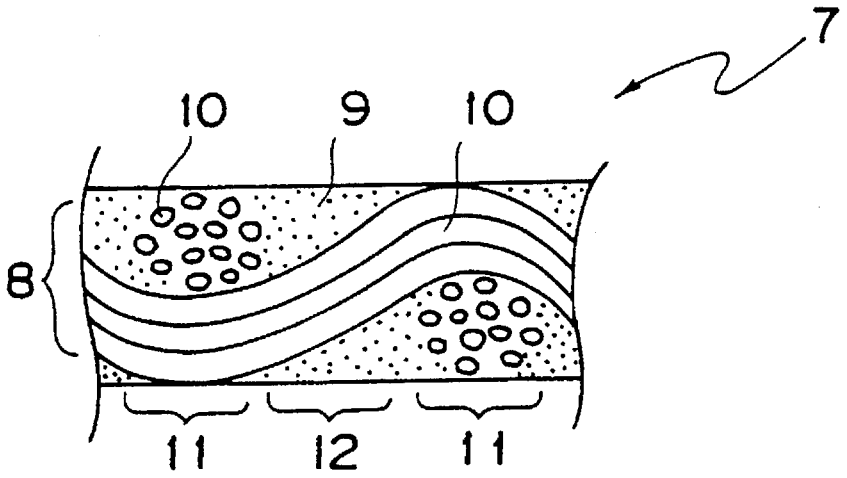
FIG. 3 is a partial cross sectional view schematically showing the internal structure of a thermally transferred image-receptive sheet produced according to the present process.

Thus, an image-receptive sheet 7 (embodiment of two sides coating) obtained by the present process comprises a substrate layer 8 and a microporous layer (image-receptive layer) 9 as schematically shown in a cross sectional view in FIG. 3. In the sheet, nylon is present in the gap between yarns 10 and, as the result, a microporous layer 9 is incorporated with a substrate. And small cover factor ratio in furnishing step affords particularly excellent smoothness.

Next, the image-receptive sheets obtained by the present process were evaluated as follows:

Five kinds of substrates shown in Table 1: (i) nylon taffeta 210/inch$^2$, 70 d (ii) polyester taffeta 190/inch$^2$, 75 d (iii) spun yarn woven fabric 40 counts, (iv) polyester/nylon core-sheath taffeta 190/inch$^2$, 50 d (v) polyester/nylon core-sheath taffeta 180/inch$^2$, 75 d) were furnished at a relatively large cover factor ratio (cover factor ratio=1.07) (in Table 1, "large") after drying step, respectively, or these furnished substrates were further subjected to rolling (calendering) (cover factor ratio=1.04) (in Table 1, "roll"), respectively. Separately, the above five kinds of substrates were furnished at a relatively small cover factor ratio (cover factor ratio= 1.01) (in Table 1, "small") after drying step. Smoothness of these substrates were determined.

Evaluation was carried out by measuring a time for which a constant amount of air has flown through a gap between the flat sheet and the uneven surface of a sample using Oken-type smoothness tester (Model KY-5) (manufactured by Asahiseiko K. K.). In the measured time, when the time is longer, smoothness is higher. Form a practical point of view, smoothness required for the image-receptive sheet is not lower than 200 seconds.

Test samples and results are shown in Table 1.

TABLE 1

| | Furnishing method | | | | |
|---|---|---|---|---|---|
| Woven fabric | density | thickness | large[1] | roll[2] | small[3] |
| Nylon taffeta | 210/inch$^2$ | 70d | 90s | 320s | 580s |
| Polyester taffeta | 190/inch$^2$ | 75d | 60s | 290s | 550s |
| Spun woven fabric | 130/inch$^2$ | 40 counts | 4s | 14s | 10s |
| Polyester/Nylon core-sheath taffeta | 190/inch$^2$ | 50d | 40s | 59s | 166s |
| Polyester/Nylon core-sheath taffeta | 190/inch$^2$ | 75d | 52s | 99s | 220s |

[1]; previous process,
[2]; previous process,
[3]; present process

As shown in Table 1, when a cover factor ratio is relatively large according to the previous method, smoothness is lower. In addition, a microporous layer may be broken in the case of a rolling method, which results in lower smoothness. On the other hand, when a cover factor ratio is small according to the present process, smoothness is improved.

A microporous layer of a thermally transferred image-receptive sheet obtained by the present process is composed of nylon which can receive a sublimating dye and has excellent smoothness as described above. Therefore, such thermally transferred image-receptive sheet is an excellent sublimation transfer-type image-receptive sheet which can give the clear image.

In addition, a microporous layer of the thermally transferred image-receptive sheet obtained by the present process can receive a heat meltable ink sufficiently. In particular, in the case where a sheet after printing requires resistance to washing, such thermally transferred image-receptive sheet can be appropriately used for printing by thermal transfer using a resin-type heat meltable ink having high fastness.

One example of the formulation of the resin-type heat meltable ink is as follows:

| | |
|---|---|
| Nylon 6/66/12 nylon | 5 weight parts |
| Carbon black | 5 weight parts |
| Methanol | 45 weight parts |
| Toluene | 45 weight parts |

The present process can be appropriately applied to production of thermally transferred image-receptive sheets which are printed and used for display label, care label, brand label, industrial label (production control label, laundry control label).

EXAMPLE

The following Examples and Comparative Examples further illustrate the present invention in detail but are not to be construed to limit the scope thereof. Part means part by weight.

Example 1

10 Parts of nylon staple, a solution of 12 parts of calcium chloride and 20 parts of methanol, and filler and other additives were mixed, the mixture was stirred at a temperature of not lower than 70° C. to obtain a nylon coating composition. The viscosity of the nylon coating composition was measured to be 9000 cps at 40° C. by a B type viscometer.

The above nylon coating composition was coated onto nylon taffeta (weight 63 g/m$^2$) composed of warps and wefts (single yarn 3 d; 70 d composed of filament count 24 f), 125 cm in width and 210/inch$^2$ in total density, using a doctor knife according to an on-roll method, while applying tension thereto. Coating conditions were such that a tip of a doctor knife was held contacted with woven fabric. An amount to be coated (wet) was 23 g/m$^2$.

The coated woven fabric was dipped into water to leach out methanol and calcium chloride contained in the composition and solidify the coated layer. After solidification of layer, the woven fabric was dried at 100° to 120 ° C. for 30 seconds.

The dried woven fabric was furnished at 180° C. for 10 seconds using a pin tenter to obtain a sheet having smoothness of 500 seconds and cushioning properties. Weight of the sheet was 72 g/m$^2$, amount of coated resin was 5 g/m$^2$ and the thickness of the sheet was 111 μm. A cover factor of a final product was 218×√70×1.7 (correction factor)=3101, a cover factor immediately after coating was 220×√70×1.7=3129, and a cover factor ratio was 1.01.

Comparative Example 1

10 Parts of nylon staple, a solution of 12 parts of calcium chloride and 20 parts of methanol, filler and other additives were mixed, and the mixture was stirred at a temperature of not lower than 70° C. to obtain a nylon coating composition. The viscosity of the nylon coating composition was measured to be 9000 cps at 40° C. using a B type viscometer.

The above nylon coating composition was coated onto nylon taffeta (weight 63 g/m$^2$) composed of warps and wefts (single yarn 3d; 70d composed of filament count 24 f), 125 cm in width and 210/inch$^2$ in total density, using a doctor knife according to an on-roll method, while applying tension thereto. Coating conditions were such that a tip of a doctor knife was held contacted with woven fabric. An amount to be coated (wet) was 23 g/m$^2$.

The coated woven fabric was dipped into water to leach out methanol and calcium chloride contained in the composition and solidify the coated layer. After solidification of the coated layer, the woven fabric was dried at 100° to 120° C. for 30 seconds.

The dried woven fabric was furnished at 180° C. for 10 seconds using a pin tenter to obtain a sheet having smoothness of 90 seconds and cushioning properties. Smoothness of this sheet is lower than that of Example 1. Weight of the sheet was 68 g/m$^2$, amount of coated resin was 5 g/m$^2$, and the thickness of the sheet was 110 μm. A cover factor of a final product was 212×√70×1.7 (correction factor)=3015, a cover factor immediately after coating was 221×√70×1.7=3143, and a cover factor ratio was 1.04.

Example 2

10 Parts of nylon staple, a solution of 12 parts of calcium chloride and 20 parts of methanol, and filler and other additives were mixed, the mixture was stirred at a temperature of not lower than 70° C. to obtain a nylon coating composition. The viscosity of the nylon coating composition was measured to be 9000 cps at 40° C. by a B type viscometer.

The above nylon coating composition was coated onto polyester taffeta (weight 65 g/m$^2$) composed of warps and wefts, 75d, 190/inch$^2$ in total density, 129 cm in width, using a doctor knife according to an on-roll method, while applying tension thereto. Coating conditions were such that a tip of a doctor knife was held contacted with woven fabric. An amount to be coated (wet) was 46 g/m$^2$.

The coated woven fabric was dipped into water to leach out methanol and calcium chloride contained in the composition and solidify the coated layer. After solidification of the coated layer, the woven fabric was dried at 100° to 120° C. for 30 seconds.

The dried woven fabric was furnished at 180° C. for 10 seconds using a pin tenter to obtain a sheet having smoothness of 550 seconds and good cushioning properties. Weight of the sheet was 79 g/m$^2$, the coated amount of resin was 11 g/m$^2$ and the thickness of the sheet was 100 μm. A cover factor of a final product was 205×√70×1.7 (correction factor)=2915, a cover factor immediately after coating was 207×√70×1.7=2944, and a cover factor ratio was 1.01.

What is claimed is:

1. A process for production of a thermally transferred image-receptive sheet which comprises:

(a) coating a coating composition, containing nylon, methanol and calcium chloride, onto a woven fabric substrate to obtain a coated layer, (b) dipping the thus-coated substrate into water to solidify the coated layer formed in step (a) and leach out methanol and calcium chloride, wherein a microporous surface layer is formed so that the bottom of woven fabric is just filled up, (c) drying the thus-dipped substrate, and (d) furnishing the thus-dried substrate to obtain a final product, wherein a cover factor of woven fabric in the final product is not lower than 1700 and a ratio of cover factor of woven fabric immediately after coating relative to that of the final product is from 0.97 to 1.03.

2. A process according to claim 1, wherein the substrate is nylon 50–150 denier taffeta, polyester 30–150 denier taffeta or polyester/nylon 30–150 denier taffeta core-sheath fiber woven fabric, provided that when the substrate is polyester/nylon 30–150 denier taffeta core-sheath fiber woven fabric, the core fiber is polyester.

3. The process according to claim 1, wherein the substrate is woven fabric composed of filament yarns which are made of synthetic fiber(s) other than nylon and polyester fiber and which have a thickness of from 30 to 210 denier.

4. A thermally imaged image-receptive sheet comprising a) a woven fabric substrate, b) a coating of microporous receiving material and c) a thermally transferred image, wherein said sheet has a cover factor which is not lower than 1700 and a ratio of cover factor of woven fabric immediately after coating relative to that of the final product of from 0.97 to 1.03.

* * * * *